US006939609B1

(12) United States Patent
Silenius

(10) Patent No.: US 6,939,609 B1
(45) Date of Patent: Sep. 6, 2005

(54) FILLER AND PIGMENT

(75) Inventor: Petri Silenius, Lohja as. (FI)

(73) Assignee: Metsä-Serla Oyj, Espoo (FI)

( * ) Notice: Subject to any disclaimer, the term of this patent is extended or adjusted under 35 U.S.C. 154(b) by 0 days.

(21) Appl. No.: 09/266,936

(22) Filed: Mar. 12, 1999

(30) Foreign Application Priority Data

Mar. 13, 1998 (FI) ..... 980566

(51) Int. Cl.[7] ..... B32B 5/16; B32B 29/00; D21H 11/00

(52) U.S. Cl. ..... 428/402; 428/537.7; 162/135; 162/181.1; 162/181.2

(58) Field of Search ..... 428/537.5, 32.19, 428/32.21, 32.22, 32.35, 32.27, 330, 323, 428/328, 331, 324, 402, 535.7; 162/135, 162/139, 181.2, 181.1; 106/400, 461

(56) References Cited

U.S. PATENT DOCUMENTS

| | | | | | |
|---|---|---|---|---|---|
| 1,934,638 | A | * | 11/1933 | Rafton | 162/181.2 |
| 3,556,109 | A | * | 1/1971 | Briskin et al. | 131/369 |
| 3,556,110 | A | * | 1/1971 | Briskin | 131/2 |
| 3,608,559 | A | * | 9/1971 | Briskin | 131/2 |
| 3,640,285 | A | * | 2/1972 | Briskin et al. | 131/2 |
| 3,861,401 | A | * | 1/1975 | Briskin et al. | 131/275 |
| 3,928,122 | A | * | 12/1975 | Griffiths et al. | 162/166 |
| 4,064,317 | A | | 12/1977 | Fukuba et al. | 428/537 |
| 4,077,414 | A | * | 3/1978 | Baker et al. | 131/336 |
| 4,187,862 | A | * | 2/1980 | Cohn | 131/349 |
| 4,225,636 | A | * | 9/1980 | Cline et al. | 427/243 |
| 4,241,142 | A | | 12/1980 | Kaliski et al. | 428/511 |
| 4,298,652 | A | | 11/1981 | Suzuki et al. | 428/323 |
| 4,303,084 | A | * | 12/1981 | Simon | 131/349 |
| 4,420,002 | A | * | 12/1983 | Cline | 131/334 |
| 4,445,970 | A | * | 5/1984 | Post et al. | 162/135 |
| 4,461,311 | A | * | 7/1984 | Mathews et al. | 131/365 |
| 4,480,650 | A | * | 11/1984 | Weinert | 131/349 |
| 4,610,801 | A | * | 9/1986 | Matthews et al. | 252/181 |
| 4,615,345 | A | * | 10/1986 | Durocher | 131/365 |
| 5,007,964 | A | | 4/1991 | Tsukisaka et al. | 106/464 |
| 5,118,533 | A | | 6/1992 | Saji et al. | 427/366 |
| 5,120,365 | A | | 6/1992 | Kogler | 106/415 |
| 5,158,806 | A | | 10/1992 | Unger | 427/359 |
| 5,340,611 | A | | 8/1994 | Kustermann et al. | 427/361 |
| 5,352,287 | A | * | 10/1994 | Wason et al. | 106/416 |
| 5,411,587 | A | | 5/1995 | Willis et al. | 106/486 |
| 5,755,871 | A | * | 5/1998 | Husson, Sr. | 106/487 |
| 5,893,372 | A | * | 4/1999 | Hampl, Jr. | 131/365 |
| 5,902,453 | A | * | 5/1999 | Ruch | 162/135 |
| 5,925,446 | A | * | 7/1999 | Matsuda et al. | 428/219 |

(Continued)

FOREIGN PATENT DOCUMENTS

DE 44 11 987 A1 10/1995

(Continued)

OTHER PUBLICATIONS

McGraw-Hill Dictionary of Chemical Terms, Sybil P. Parker ed., McGraw Hill Book Company, New York, 1985, p70.*

(Continued)

*Primary Examiner*—Kevin R. Kruer
(74) *Attorney, Agent, or Firm*—Sterne, Kessler, Goldstein & Fox P.L.L.C.

(57) ABSTRACT

The present invention relates to the use of calcium oxalate as a filler or pigment. In particular described herein is a method of reducing the combustion residue of coated paper or cardboard products by replacing at least a part of the conventional pigments and filler needed for achieving predetermined optical properties with calcium oxalate.

11 Claims, 1 Drawing Sheet

U.S. PATENT DOCUMENTS

| | | | | | |
|---|---|---|---|---|---|
| 5,997,626 | A | * | 12/1999 | Wu et al. | 106/486 |
| 6,004,467 | A | * | 12/1999 | Bleakley | 210/717 |
| 6,138,684 | A | * | 10/2000 | Yamazaki et al. | 131/365 |

FOREIGN PATENT DOCUMENTS

| | | | | |
|---|---|---|---|---|
| EP | 0 461 768 | A1 | | 12/1991 |
| EP | 0 496 269 | A2 | | 7/1992 |
| EP | 0 515 757 | A1 | | 12/1992 |
| EP | 0 624 686 | A1 | | 11/1994 |
| EP | 0 853 159 | A1 | | 7/1998 |
| EP | 0 908 557 | A1 | | 4/1999 |
| EP | 0 908 558 | A1 | | 4/1999 |
| EP | 0 908 561 | A1 | | 4/1999 |
| FI | 74215 | | | 10/1979 |
| FI | 63614 | | | 5/1980 |
| FI | 66221 | | | 3/1981 |
| FI | 67568 | | | 12/1984 |
| FI | 884196 | | | 3/1989 |
| FI | 96695 | | | 9/1989 |
| FI | 932475 | | | 5/1993 |
| FI | 961026 | | | 9/1997 |
| FR | 2 468 688 | | | 5/1981 |
| GB | 496 775 | | | 12/1938 |
| GB | 1 001 778 | | | 8/1965 |
| GB | 1 030 195 | | | 5/1966 |
| GB | 2 189 714 | A | | 11/1987 |
| GB | 2 262 542 | A | | 6/1993 |
| JP | 52032975 | | * | 6/1991 |
| SE | 8904337-6 | | | 6/1991 |
| SE | 8904337 | A | * | 6/1991 |
| SE | 500 472 | | | 1/1992 |
| SE | 9 202 072 | A | | 4/1994 |
| WO | WO 85/03316 | | | 8/1985 |
| WO | WO 95/28522 | | | 10/1995 |

OTHER PUBLICATIONS

Dialog File 351 (Derwent World Patents Index) Derwent English language abstract of SE 9202072A (Document AM6), WPI Accession No. XP002130598.

European Search Report for European Application No. 99660045, mailed Feb. 25, 2000; corresponding to U.S. Appl. No. 09/266,936.

Barzyk, D., et al., "Acidic Group Topochemistry and Fibre-to-Fibre Specific Bond Strength," *J. Pulp Paper Sci. 23*(2): J59-J61 (Feb. 1997).

Dahlvik, P., et al., "Interactions in Coating Colors Induced by Temperature-Sensitive Cellulosic Polymer," *Intl. Paper and Coating Chem. Symp.*, Ottawa, Canada, pp. 155-162 (Jun. 1996).

Malinen, R., "Recent trends in kraft pulping in Finland," *Paper and Timber 75*(*1-2*):14-15 and 17-19 (1993).

Sundberg, K., et al., "Interactions between simple electrolytes and dissolved and colloidal substances in mechanical pulp," *Pulp Paper Res. J. 9*(2):125-128 (1994).

Dialog File 351 (World Patents Index): English language abstract of FI Patent No. 74215, Application No. 791379 (Document AO1), WPI Accession No. 79-811868/197945.

Dialog File 351 (World Patents Index): English language abstract of FI Patent No. 63614, Application No. 793370 (Document AP1), WPI Accession No. 80-35899C/198020.

Dialog File 351 (World Patents Index): English language abstract of FI Patent No. 6621, Application No. 802938 (Document AL2), WPI Accession No. 81-25892D/198115.

Dialog File 351 (World Patents Index): English language abstract of FR 2 468 688 (Document AM2), WPI Accession No. 81-50171D/198128.

English language abstract of FI Patent No. 67568 (Document AN2).

Dialog File 351 (World Patents Index): English language abstract of FI Patent No. 884196 (Document AL3), Derwent World Patents Index, WPI Accession No. 89-087231/12

Dialog File 351 (World Patents Index): English language abstract of FI 99695 (Document AM3), WPI Aceession No. 89-265340/198937.

English language abstract for SE Patent No. 500 472 (Document AO3).

Dialog File 351 (World Patents Index): English language abstract of FI 932475 (Document AM4), WPI Accession No. 92-219675/27.

English language abstract of DE Patent No. 44 11 987 A1 (Document AP4).

Dialog File 351 (World Patents Index): English language abstract of FI 961026 (Document AM5), WPI Accession No. 97-437502/199741.

Høydahl, H.-E., "Thermomechanical pulp—fashionable or realistic fiber alternative," *Norsk Skogind. 29*(*12*):323-328 (Dec. 1975).

Dialog File 240 (Paperchem): English language abstract of Hoydahl, H.-E., "Thermomechanical pulp—fashionable or realistic fiber alternative," *Norsk Skogind. 29*(*12*):323-328 (Dec. 1975, (Document AR6), Caeser Accession No. 2935.

Kärenlampi, P., "Tensile Strength of a Mixture of Two Pulps," *J. Pulp Pap. Sci. 21*(*12*):J432-436 (Dec. 1995).

Pisarevskaya, E. A. et al., "Production of bleached aspen groundwood at the Zhidachev Mill," *Bumazh. Prom. 1*:17-18 (Jan. 1981).

Dialog File 240 (Paperchem): English language Abstract for Pisarevskaya, E. A. et al., "Production of bleached aspen groundwood at the Zhidachev Mill," *Bumazh. Prom. 1*:17-18 (Jan. 1981), (Document AR7), Caeser Accession No. 2921.

Richardson, C. A., "TMP (Thermomechanical pulp) in coating base stock," *CPPA Ann. Mtg.* (*Montreal*) *Preprints 63B*:49-51 (Feb. 1977).

Vulchev, V. et al., "Manufacture of groundwood from chips," *Tseluloma Khartiya 9* (*4*):5-9 (1978).

Dialog File 240 (Paperchem): English language abstract for Vulchev, V. et al., "Manufacture of groundwood from chips," *Tseluloza Khartiya 9*(*4*):5-9 (1978), (Document AS8), Caeser Accession No. 2924.

*Patent for Inventions.* Abridgments of Specifications, Herlad Printing Works, York, 1954, Abstract for U.K. Patent No. 623,357, p. 39.

*Patent for Inventions*, Abridgments of Specification, Herlad Printing Works, York, 1954, Abstract for U.K. Patent No. 609,927, pp. 141-142.

Laurila, J. and Hattari, A., *Paper and Board Dictionary—theory, manufacture and products*, The Finnish Paper and Timber Journal, Publishing Co., pp. 634, 636 (1996).

*Pulp and Paper Dictionary*, <http://www.paperonweb.com/dict11.htm> (visited on Feb. 21, 2001).

Scan-test methods, Dec. 1, 2000, Swedish Pulp and Paper Research Institute <http://www.stfi.se/documents/contract/services/standard/methods.htm> (last updated on Dec. 13, 2000>.

* cited by examiner

FILLER AND PIGMENT

FIELD OF THE INVENTION

The present invention concerns a novel filler and pigment which can be used for producing paper, cardboard, polymers, paints, putties and similar products. In particular the invention concerns the use of calcium oxalate as a filler and/or a pigment in coated paper and cardboard having a predetermined brightness and opacity.

The invention also concerns a web of coated fibrous material.

BACKGROUND OF THE INVENTION

Today, the trends of paper product development are to a growing extent decided by the buyers and by legislative measures. The buyers of printing papers want to save mailing costs and to cut the amount of waste generated. Waste management fees have also been imposed on packages, the amounts of which depend on the weight of the product. Generally, it appears that various energy and emissions taxes will have to be incorporated into the price of paper products, forming an extra cost load. For these reasons the paper buyers would like to have paper products of low grammage which, nevertheless, fill high quality standards. On the other, for the paper-based information distribution to be able to compete successfully with electronic media, it is required that the printing result of the paper products be further improved.

The above mentioned general trends put rather high requirements on the raw materials of the paper and on the manufacturing processes. Recently, in order to fulfil the requirements, extensive efforts have been made in order to improve the paper raw materials and the manufacturing processes thereof. It is an aim to manufacture high-quality papers by using smaller amounts of raw materials than before. When the grammage of the paper is reduced, the opacity of the paper become a critical feature. Opacity can be enhanced by increasing the filler content of the paper. This, however, reduces the strength of the paper and therefore efforts are being made to change the structure of the paper while still maintaining the important product properties. One additional property which is related to an increase of the filler and pigment amounts of paper and cardboard products is the increase of the residual ash, which makes it more difficult to utilize recirculation fibers e.g. in energy production and to destroy them by burning, respectively. Furthermore the present mineral based fillers and pigments cause great wear on the wire. This shortens the operational time of the wires.

BRIEF SUMMARY OF THE INVENTION

It is an object of the present invention to remove the disadvantages of the prior art and to provide an entirely novel kind of solution for coating of papers and cardboards and for filling of papers, cardboards, polymers, paints and different pastes, putties and dispersions, in particular polymer dispersions. It is a particular aim of the present invention to provide a pigment and filler of papers and cardboards which makes it possible to lower the grammage without impairing the optical properties, in particular the opacity, of the paper. Further, according to the present invention novel kinds of paper and cardboard products are aimed at, said products having a reduce ash content and an improved heat/fire resistance.

The invention is based on the idea of using calcium oxalate, $CaC_2O_4$, as a filler and/or as a pigment. Calcium oxalate is practically insoluble in water at neutral and alkaline conditions. It is therefore suitable for use as a filler of paper and cardboard in modern paper making processes just as calcium carbonate. Furthermore, it has good optical properties which enable the use of it as a pigment in many products. The combustion residue of calcium oxalate is considerably much smaller than of conventional pigments and, according to the present invention, calcium oxalate can therefore be used for replacing at least a part of the conventional pigments and fillers needed for achieving a predetermined brightness and opacity of a paper or cardboard. Because the wear caused by the calcium oxalate is small it can be used e.g. in toothpastes and other pastes in which the filler is expected to cause a minimum of abrasion.

More specifically, the method of reducing the combustion residue of coated paper and cardboard exhibiting a predetermined brightness and opacity according to the present invention is characterized by replacing at least a part of the amount of conventional filler and/or coating pigment necessary for reaching the predetermined brightness and opacity with calcium carbonate.

The material web according to the invention is characterized wherein the coated fine paper has an ISO brightness of over 80% and an opacity of over 80% and wherein the coated fine paper contains as a filler and/or pigment calcium oxalate optionally together with fillers and coating pigments, respectively.

The present invention provides considerable advantages. Thus, as mentioned above, the optical effect of calcium oxalate is very good. Paper coated with this pigment has a good opacity and the surface weight thereof can be lowered. On the other hand the density of this pigment is smaller than that of conventional pigments which helps in reducing the grammage. According to the present invention sufficient opacity can be obtained by using less filler which gives the paper a better strength. By using calcium oxalate as a pigment and/or filler of paper, a lighter paper is obtained as a result, said paper having excellent optical properties.

Next, the invention will be examined more closely with the aid of the following detailed description and with reference to a number of working examples.

DETAILED DESCRIPTION OF THE INVENTION

Figure 1:
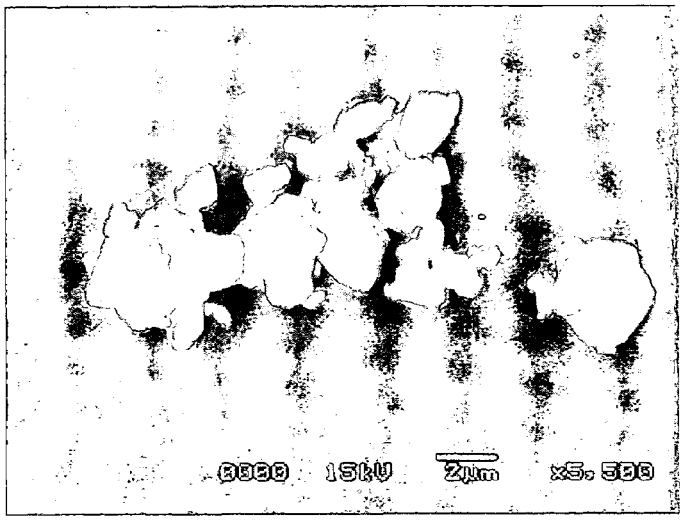
FIG. 1 is an electron microscope image of calcium oxalate crystals.

The structure of calcium oxalate is $$Ca(OOC)_2 \quad \text{(I)}$$

Usually, it is present in hydrated form, having the brutto formula $$CaC_2O_4 \times nH_2O \quad \text{(II)}$$

wherein n is usually 1 or 2, generally 1 (monohydrate).

In Nature, it can be found in many plant cells and, e.g., in uroliths and kidney stones. As a pure substance it is generally classified as a laboratory chemical and it has been used for analytical purposes for determining calcium. Generally the oxalates have been found to have a lubricating effect as a metal coating (encyclopedia of Chemical Technologyn, Third Edition, Kirk Othmer, Vol. 16, p. 630, John Wiley & Sons, New York). For oxalic acid there are a number of known uses, including treatment, cleaning and coating of metals Also cleaning of textiles and coloring of various objects is known in the art.

According to SE Patent Application 8904337-7, calcium oxalate can be employed for reducing light-induced yellowing of wood-containing papers. However, said reference is silent about the use of calcium oxalate as a filler or pigment for reducing the combustion residue of papers and cardboards, in particular coated papers, having a predetermined brightness and opacity.

The present invention utilizes the finding that the light scattering coefficient of calcium oxalate in coating layers is very large (on the order of 250 to 500 $m^2$/kg, depending on the structure of the layer). We have found that the pigment packing is very optimal for the optical properties. In other word, although the refractive index is quite conventional the pigment provides a great light scattering index and, thus, great opacity potential. The value for the light scattering coefficient is very large compare even to titanium dioxide, which has a very large refractive index and for which the light scattering coefficient is on the order of 160 $m^2$/kg. As regards optical effect, the packing of the particules and, further, the structure of the coating are of central importance.

By using calcium oxalate as a pigment or filler it is possible to produce papers and cardboard having high opacity and/or brightness. In particular, by using calcium oxalate as the sole pigment and/or filler or as a part of the pigment/filler residue of papers or cardboards it is possible to obtain products having an ISO brightness of 80% or more, preferably 90% or more. The opacity of the products can be increased to 80% or more, preferably 90% or more by using calcium oxalate as a filler/pigment.

In our tests we have further found that the wear caused by Ca-oxalate is very small compared to the wear caused by conventional pigments. This means that by adding it to coating colours instead of conventional pigments it will also be possible to decrease the wear of the wire.

Calcium oxalate has a very small solubility in water. Of the monohydrate only 0.0067 g/l dissolves in water at 13° C. and even at 95° C. only 0.014 g/l, which corresponds to the amount of calcium carbonate in calcite form dissolved at room temperature. The solubility of the dihydrate is even smaller. The solubility of gypsym is almost 500-times greater than for calcium oxalate. By replacing a part of traditional-fillers and pigments with calcium oxalate it is possible essentially to reduce the amount of soluble disturing substances at a paper mill.

Thermally, the calcium oxalate monohydrate is decomposed in three stages; first it releases evaporating (crystal) water, subsequently carbon monoxide is released and then carbon dioxide and finally calcium oxide is obtained. As a result of the thermal decomposition the weight of the calcium oxalate is reduced with 80%. For this reason the amount of ash in paper and cardboard can be clearly reduced by replacing kaolin, gypsym or calcium carbonate with partially or entirely with calcium oxalate. This feature is also examined in Example 4 below. The combustion residue of papers and cardboards coated and/or filled with calcium oxalate can be as low as 50%, preferably less, e.g. below 35 or 30%, depending on the proportion of the calcium oxalate of the pigments and/or fillers of the product.

It should be pointed out that both water and carbon monoxide and carbon monoxide are capable of displacing air and oxygen and being incombustible gases in particular water and carbon dioxide clearly increase the heat and fire resistance of paper or cardboard. With the aid of the invention it is therefore possible to produce essentially fire-proof material webs.

Although the paper or cardboard material produced by the present invention is not easily (or spontaneously) ignited, it can still be discarded and destroyed by burning (combusting) it together with other flammable components, such as other paper and cardboard products or polymers etc. The present invention therefore provides for an advantageous method of discarding paper and cardboard products by combustion. The method comprises collecting used paper and/or cardboard products having a calcium oxalate content of at least 10% of the dry matter and preferably of at least 50% of the total pigment/filler content of the products, combusting the paper and/or cardboard products, recovering the heat generated during combustion, and collecting and discarding the ash.

According to a preferred embodiment of the invention, a wood-containing or wood-free base paper can be provided for use in flame-proof wall papers. As known in the art, a wall paper can be considered non-flammable if it contains, e.g. 15% or less living fibre, whereas the balance is made up of rock (i.e. of mineral fillers/pigments), which is not easily combustible. According to the invention, the capability of calcium oxalate of releasing gases which displace oxygen can effectively be utilized, and calcium oxalate can therefore be used as an active fire retardant. Wall papers containing more than 85% calcium carbonate (calculated from the dry weight) are at least essentially incombustible and they would probably also meet the coming SBI EU-standard, according to which a test specimen should resist a 70 cm propane flame having an effect of 40 kW/$m^2$.

As a filler, calcium oxalate is applied in amounts of about 0.1 to 90%, preferably about 1 to 80% of the dry matter, and as a pigment it can be applied at about 1 to 100 g/m for each side of the web. Preferably the calcium oxalate proportion of the entire amount of pigments and fillers is about 10 to 100, in particular 10 to 95%.

Calcium oxalate can be prepared by precipitation from oxalate solutions with calcium salts. It is also commercially available.

Precipitated calcium oxalate monohydrate has already as such a rather narrow particle size distribution, which can be further improved by milling. The average particle size of the precipitated product is about 3 $\mu$m, whereas the mediate size of ground calcium oxalate is about 1.2 $\mu$m. Over 90% of the ground calcium oxalate particles are smaller than 2.3 $\mu$m, but only 10% are smaller than 0.5 $\mu$m. This steep distribution provides good optical properties. The particle size distribution is examined in more detail in Example 1.

FIG. 1 shows an electron microscope picture of milled calcium oxalated crystals. The Figure also shows that the crystals are very much of equal size and about spherical.

For use as a filler precipitated calcium oxalate is suitable as such or milled.

The use of calcium oxalate as a filler and a pigment is described in the following in particular in connection with the manufacture of cellulosic products. It should however be pointed out that the same advantages and features, in particular the optical properties, associated with these working example can effectively be utilized in many other fields of industry. Calcium oxalate can be employed as a filler in the polymer and paint industry and for the production of pastes and polymer dispersions. It is also conceivable that calcium oxalate can be used in cosmetic preparations, in pharmaceuticals (including toothpastes), in washing powders, fertilizers, etc.

The term "cellulosic material" denotes paper or board or a corresponding cellulose-containing material, which is derived from a lignocellulosic raw material, in particular from wood or from annual or perennial plants. Said material can be wood-containing or wood-free (LWC, SC, coated printing papers and fine papers) and it can be produced from mechanical, semi-mechanical (chemi-mechanical) or chemical pulp. The pulp can be bleached or unbleached. The material can also contain recycled fibers, in particular reclaimed paper or reclaimed board. Typically, the grammage of the material web lies in the range of 35 to 500 g/m$^2$.

Calcium oxalate is used as a filler of the cellulosic material in a manner known per se. Thus, a stock is formed from mechanical or chemical pulp by slushing the pulp into water. Filler is added in desired amount, typically 0.1 to 90%, preferably about 1 to 70%, calculated from the total weight of the web, the consistency of the stock being generally about 0.1 to 5%. The aqueous phase of the stock comprises, for example, clarified filtrate of circulating water of the paper machinne. The pH of the pulp which is fed to the head-box is neutral or slightly alkaline. Typically the pH is about 6.5 to 8. The pH on the paper machine can be somewhat higher than of the dosing, typically about 6.8 to 8.5. If necessary, for adjusting the pH of the stock and for controlling the pH during paper making a suitable base or acid is used. The base comprises in particular an alkali metal bicarbonate or carbonate or alkali metal hydroxide. The acids used comprise mineral acids and acidic salts. Preferred acids comprise sulphuric acid and its acidic salts such as alum and the preferred base is sodium bicarbonate. The paper web is formed on a paper machine in a manner known per se.

Calcium oxalate can be formulated into suitable coating colours. In the present invention "coating colour" means a composition designed for the coating or surfacing of paper or board, containing water and components known per se, such as pigments, binding agent and a component regulating the viscosity (a thickening agent). In addition to calcium oxalate, the following pigments can be used: calcium carbonate, calcium sulphate, aluminum silicate, kaolin (aluminum silicate containing crystallization water), aluminum hydroxide, magnesium silicate, talc (magnesium silicate containing crystallization water), titanium oxide, silica, and barium sulphate and mixtures of these. Also synthetic pigments may be employed. Primary pigments of those mentioned above are calcium oxalate, kaolin and/or calcium carbonate, usually amounting to over 50% of the dry matter of the coating composition. Calcinated kaolin, titanium oxide, precipitated carbonate, satin white, aluminum hydroxide, sodium silica aluminate and plastic pigments are additional pigments and the amounts of these are usually below 25% of the dry matter content of the mixture. Special pigments to be mentioned are special kaolins and calcium carbonates and barium sulphate and zinc oxide.

Any binding agent know per se, which is frequently used for manufacturing paper, can be used as a binder. In addition to individual binders it is also possible to use mixtures of binding agents. As specific examples of typical binding agents the following can be mentioned: synthetic latex-type binders consisting of polymers or copolymers of ethyleneically unsaturated compounds, such as butadiene-styrene type copolymers which can contain a comonomer with a carboxylic group, such as acrylic acid, itaconic acid or maleic acid, and poly(vinyl acetate) which contains comonomers having carboxylic groups. In combination with the afore-mentioned substances e.g. water-soluble polymers, starch, CMC, hydroxy ethyl cellulose and poly(vinyl alcohol) can be used as binders.

In the coating mixture there can further be used conventional additives and adjuvants, such as dispersing agents (e.g. sodium salt of poly(acrylic acid)), substances for adjusting the viscosity and water rentention of the mixture (e.g. CMC, hydroxyethyl cellulose, polyacrylates, alginates, benzoate), lubricating agents, hardeners for improving the water resistance, optical agents, anti-foaming agents and substances for regulating the pH and for preventing product degradation. The lubricating agents include sulphonated oils, esters, amines, calcium and ammonium stearates; the agents improving water resistance include glyoxal; optical agents include diaminostilben and derivatives of disulphonic acid; the anti-foaming agents include phosphate esters, silicones, alcohols, ethers, vegetable oils, the pH-regulators include sodium hydroxide and ammonia; and, finally, the anti-degradation agents include formaldehyde, phenol and quaternary ammonium salts.

The coating compositions according to the present invention can be used both as pre-coat mixtures and as surface coating colours. For 100 parts by weight of pigment the coating colour typically contains about 0.1 to 10 parts by weight of the thickening agent and 1 to 20 parts by weight of a binder.

The composition of a typical pre-coat mixture is the following:

| | |
|---|---|
| pigment/filler (calcium oxalate optionally together with some other pigment) | 100 parts by weight |
| thickener | 0.1 to 2.0 parts by weight |
| binder | 1 to 20 parts by weight |
| additives | 0.1 to 10 parts by weight |
| water | balance |

The composition of a surface coating colour according to the present invention is, for example, the following:

| | |
|---|---|
| pigment/filler I (calcium oxalate) | 30 to 90 parts by weight |
| optionally a second pigment/filler II (e.g. fine kaolin and/or carbonate) | 10 to 30 parts by weight |
| total pigment | 100 parts by weight |
| thickener | 0.1 to 2.0 parts by weight |
| binder | 1 to 20 parts by weight |
| additives | 0.1 to 10 parts by weight |
| water | balance |

The amount of a coating applied on both sides of the web is typically about 5 to 100 g/m$^2$.

The opacity of papers coated with calcium oxalate pigments is generally over 95% and an ISO brightness level of 92% can be reached.

The following non-limiting examples illustrate the invention. The light scattering coefficients, light absorption coefficients and opacities have been determined by the standard SCAN 8:93. ISO brightness (R457) has been determined according to standard SCAN-P 3:93. The grammage of the sheets and their thicknesses are determined according to standards SCAN-P 6:75 and SCAN-P 7:75, respectively.

Example 1

Figure 2:
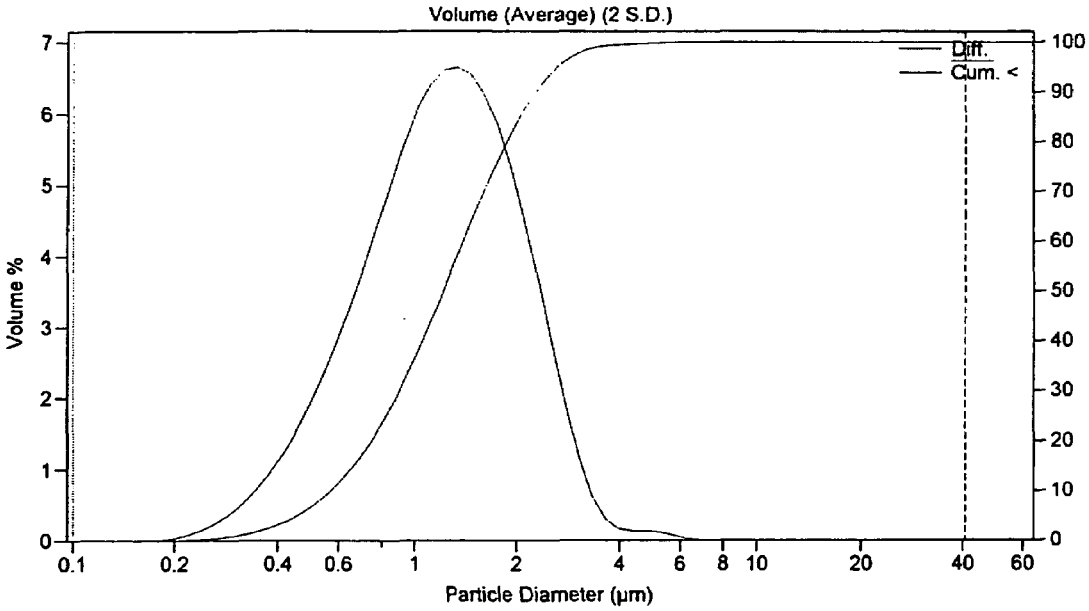
FIG. 2 shows the particle size distribution of milled calcium oxalate.

Manufacture of a Calcium Oxalate Product of Pigment-Quality and the Particle Size of the Calcium Oxalate Calcium oxalate monohydrate powder ($CaC_2O_4 \times H_2O$) of laboratory quality was slurried in water. The slurry was milled in a ball mill with 1 mm glass pearls without additives. The milled material was drained with a ceramic filter and the particle size distribution of the product was assayed with a Coulter LS (cf. FIG. 2). Numerically the particle size distribution was as follows:

TABLE 1

Pigment size distribution of milled calcium oxalate

| %< | 10 | 25 | 50 | 75 | 90 |
|---|---|---|---|---|---|
| Size, μm | 0.676 | 0.992 | 1.491 | 2.173 | 2.920 |

Thus, the particle size distribution of calcium oxalate is rather narrow which is beneficial for good optical properties.

The dry matter content of the product was 54 wt-% and the average particle size 1.4 μm.

Example 2

Determination of Specific Area and Wearability of Calcium Oxalate

Using the milled slurry of Example 1 the wear caused on the wire and the specific area (BET) of Ca oxalate were determined.

The BET specific area of the sample was 4.4 $m^2/g$. The specific area of calcium oxalate was on the same order as for some PCC qualities.

The wearability of calcium oxalate was 2.79 $g/m^2$. In Table 2, calcium oxalate has been compared to traditional pigments.

TABLE 2

Wearability

| Pigment | Wearability, $g/m^2$ |
|---|---|
| ZnO, red lable | 12.5 |
| ZnO, gold lable | 0.7 |
| $CaCO_3$, HC90 | 36.2 |
| PCC (skalenoedrical) | 6.0 |
| SPS kaolin | 10.1 |
| Talc | 13.0 |
| Calcium oxalate | 2.49 |

As the table clearly shows, calcium oxalate causes clearly less wear on the wire than most of the conventional pigments.

Example 3 [Esimerkki]

Determination of the Optical Properties of Coating Layers and of Coated Paper

The slurry of Example 1 was also subjected to determination of the light scattering and light absorption coefficients (Y and R475) of Ca oxalate. The determinations were made on both glass sheets and base paper. The optical properties determined comprised the S- and K-values and the opacities. The values were determined at two different wave lengths (viz. 557 nm and 457 nm).

In order to determine the properties of the calcium oxalate film the pigment slurry was first applied on a glass sheet using a paste spreader with two different thicknesses of the layers.

From the films made on the glass sheets, $R_o$ and $R_{oo}$ were first determined from the coated part. A piece of cardboard which had been coated with Ca oxalate slurry was used as background for the determination of the $R_{oo}$. For determining the thickness of the layer the thickness of the glass sheet was determined both for the coated and the uncoated parts. The surface area was determined by weighing the sheet and then by washing away the slurry film and weighing the sheet again.

The results of determining the surface areas, thicknesses and optical properties of the films made on the glass sheets are given in Table 3.

TABLE 3

Properties of calcium oxalate films made on glass sheets

| Thickness of coating layer | 95 μm | 61 μm |
|---|---|---|
| 557 nm | | |
| Opacity, % | 96.5 | 96.3 |
| 457 nm | | |
| Light scattering coefficient, $m^2/kg$ | 360 | 430 |
| Light absorption coefficient, $m^2/kg$ | 1.27 | 2.82 |
| Opacity, % | 98.4 | 95.7 |
| ISO Brightness, % | 91.9 | 89.2 |
| Surface weight $g/m^2$ | 39.5 | 17.4 |
| Thickness (coated), μm | 1076 | 1041 |
| Thickness (uncoated), μm | 981 | 980 |

Next, the slurry was applied to a base paper containing mechanical pulp, having a surface weight of 47.0 $\mu m^2$.

Corresponding measurements as above were made for the base paper and for combinations of base paper and pigment film. Since the s- and k-values can be considered additive properties, the presented results have been counted in such a way that the effect of the base has been substracted from the results obtained with the base+pigment film combination. The results are presented in Table 4.

TABLE 4

Properties of calcium oxalate layers made on base paper

| Sample | Base paper, thickness 78 μm | Coated paper, thickness 92 μm |
|---|---|---|
| 557 nm | | |
| Opacity, % | 86.2 | 93.4 |
| 457 nm | | |
| Light scattering coefficient, $m^2/kg$ | 55.7 | 232 |
| Light absorption coefficient, $m^2/kg$ | 2.19 | 0.46 |
| Opacity, % | 88.8 | 96.2 |
| ISO brightness, % | 75.6 | 82.2 |
| Surface weight, $g/m^2$ | 47.0 | 13.2 |

In summary of the above-presented results it should be noted that the light scattering coefficient of calcium oxalate is very large and measured from a coating layer it is in the range of 250 to 500 $m^2/kg$ depending on particle size and size distribution. The great value indicates that the packing of the pigments is very optimal for the optical properties. In other words, in spite of a refraction index of conventional magnitude (about 1.5 to 1.6) the pigment provides an extremely large light scattering coefficient and, thus, a great opacity potential. As regards opticial effect the packing of the particles and, further, the structure of the coating are very central features.

Example 4

The combustion residue of paper containing calcium oxalate was determined from the following laboratory sheets, having a mass of 1.63 g (dry):

| | |
|---|---|
| Sheet 1 (reference): | 40 wt-% keolin; 60 wt-% fibers |
| Sheet 2 (reference): | 40 wt-% calcium carbonate; 60 wt-% fibers |
| Sheet 3 | 40 wt-% calcium oxalate; 60 wt-% fibers. |

The sheets were burnt and the combustion residues were measured by weighing.

The combustion residues were as follows:

| | |
|---|---|
| Sheet 1: | 0.65 g |
| Sheet 2: | 0.46 g |
| Sheet 3: | 0.25 g |

Thus, the sheet containing calcium oxalate contained a clearly smaller residue after combustion than the sheet containing other pigments. This feature has a great importance for reducing the waste of the paper, which further diminishes costs at dump pits.

What is claimed is:

1. Coated, wood-free paper comprising a pigment comprising calcium oxalate, wherein said coated, wood-free paper has an ISO brightness of over 80% and an opacity of over 80%, wherein said calcium oxalate is a monohydrate that has been ground and over 90% of the particles of said ground calcium oxalate that are used are smaller than 2.3 gm and only 10% are smaller than 0.5 um.

2. The coated, wood-free paper according to claim 1, wherein said paper further comprises a filler that comprises calcium oxalate.

3. The coated, wood-free paper according to claim 1 or 2, wherein said coated, wood-free paper has a maximum combustion residue of 35%, calculated from the total weight of dry matter of the coated, wood-free paper.

4. The coated, wood-gee paper of claim 1 or 2, wherein said coated, wood-free paper further comprises fillers or coating pigments other than calcium oxalate.

5. A method of reducing wear of a coated, wood-free paper-making wire, wherein said method comprises incorporating calcium oxalate into the coating of said coated, wood-free paper, wherein said calcium oxalate comprises 10 to 100% by weight of total pigment, wherein said calcium oxalate is a monohydrate that has been ground and over 90% of the particles of said ground calcium oxalate that are used are smaller than 2.3 gm and only 10% are smaller than 0.5 um.

6. The method according to claim 5, wherein said paper comprises a filler that comprises calcium oxalate.

7. A method of reducing the combustion residue of coated, wood-free paper wherein said method comprises making said coated, wood-free paper with a coating pigment comprising calcium oxalate, wherein the proportion of calcium oxalate that is in said pigment is between 10% and 100% by weight of said pigment, wherein said calcium oxalate is a monohydrate that has been ground and over 90% of the particles of said ground calcium oxalate that are used are smaller than 2.3 gm and only 10% are smaller than 0.5 um and wherein said coated, wood-free paper has an ISO brightness of 80% or more and an opacity of 80% or more.

8. The method according to claim 1, wherein said ISO brightness is over 90% and said opacity is over 90%.

9. The method according to claim 1, further comprising making said paper with a filler that comprises calcium oxalate.

10. The method according to any one of claims 1, 8 and 9, said method further comprising using a second pigment selected from the group consisting of calcium carbonate, calcium sulphate, aluminum silicate, kaolin, aluminum hydroxide, magnesium silicate, talc, titanium dioxide, silica, barium sulphate and combinations thereof.

11. The method according to any one of claims 9, 6, and 2, wherein said paper comprises a second filler selected from the group consisting of calcium carbonate, calcium sulphate, aluminum silicate, kaolin, aluminum hydroxide, magnesium silicate, talc, titanium dioxide, silica, barium sulphate, and combinations thereof.

* * * * *